US005369416A

United States Patent [19]

Haverty et al.

[11] Patent Number: 5,369,416

[45] Date of Patent: Nov. 29, 1994

[54] MULTI-COLOR BARGRAPH

[75] Inventors: Donald Haverty, Pelham, N.H.; Leon G. Wilde, Andover; Dinesh Rana, Somerville, both of Mass.

[73] Assignee: Indikon Company, Inc., Cambridge, Mass.

[21] Appl. No.: 900,004

[22] Filed: Jun. 17, 1992

[51] Int. Cl.[5] ..... G09G 3/00

[52] U.S. Cl. ..... 345/39; 345/35

[58] Field of Search ..... 340/701, 722, 753, 754, 340/782; 324/96, 115, 116; 345/35–40, 140

[56] References Cited

U.S. PATENT DOCUMENTS

| | | | |
|---|---|---|---|
| 3,125,985 | 3/1964 | Kallinger | 116/62.1 |
| 3,947,840 | 3/1976 | Craford et al. | 340/324 M |
| 3,987,401 | 10/1976 | Irving | 340/753 X |
| 4,183,025 | 1/1980 | Kutarazi et al. | 340/735 X |
| 4,251,769 | 2/1981 | Ewert et al. | 340/753 X |
| 4,298,869 | 11/1981 | Okuno | 340/782 |
| 4,550,287 | 10/1985 | Babcock | 324/73 R |
| 4,673,252 | 6/1987 | Kuzo et al. | 340/701 X |
| 4,688,029 | 8/1987 | Kawasaki et al. | 340/618 X |
| 4,736,198 | 4/1988 | Tokuyama et al. | 340/753 X |
| 4,756,017 | 7/1988 | Bush | 379/23 |
| 4,812,744 | 3/1989 | Havel | 340/753 X |
| 4,846,467 | 7/1989 | Rosson | 273/1 G E |
| 4,868,496 | 9/1989 | Havel | 340/753 X |
| 4,874,253 | 10/1989 | Pompei et al. | 374/121 |
| 4,964,803 | 10/1990 | Chul | 434/118 |
| 4,992,775 | 2/1991 | Castle et al. | 340/525 |
| 5,057,965 | 10/1991 | Wilson | 361/212 |

FOREIGN PATENT DOCUMENTS

| | | | |
|---|---|---|---|
| 0107109 | 6/1985 | Japan | 340/722 |

OTHER PUBLICATIONS

Universal Bargraph, by the Triplett Corporation, One Triplett Drive, Bluffton, Ohio.

Solid State Analog Panel Meters, by Bowmar/ALI, 531 Main Street, Acton, Mass.

Vibration Monitors, by PMC/BETA Corporation, 4 Tech Circle, Natick, Mass.

*Primary Examiner*—Jeffery Brier

*Attorney, Agent, or Firm*—Weingarten, Schurgin, Gagnebin & Hayes

[57] ABSTRACT

A bargraph with a single set of light emitting diode (LED) segments creates a display showing a parameter level by the number of segments illuminated and a separate condition by the color of all illuminated segments. For example, an input parameter in a normal data range results in all segments below and at the data level being illuminated in a first color. Satisfaction of a first set point condition by that or another input results in all segments below and at the data level being illuminated, but all illuminated in a second color; and satisfaction of a second set point condition results in all segments below and at the data level being illuminated, but all illuminated in a third color. All of the segments below the data level change color with passage of the set point. The bargraph combines present data value, alarm set points, and indication of set point exceedance in a single bargraph through use of multi-color activated segments. The bargraph has single and dual channel applications, and may display either uni-polar or bi-polar information. Condition exceedance may be in either direction. The bargraph control circuit may incorporate a latch and reset function, a peak hold function, a sensor status monitor, and a decimal output for a supplemental numeric display. An additional dimension of information can be provided by flashing the LED's.

11 Claims, 6 Drawing Sheets

MULTI-COLOR BARGRAPH

FIELD OF THE INVENTION

The invention relates to the field of electrical instrumentation, and more particularly to a multi-color display useful for monitoring the status of electrical equipment.

BACKGROUND OF THE INVENTION

Bar type or linear displays have been in use for many years in instrumentation for presenting data to an operator, as an alternative to circular gauges using needles, or alpha-numeric displays. Bargraph displays emulate vertical or horizontal bars, the length of which represents the level of an input to the instrument. It is also known to create an alarm such as a separate light or sound when an input value exceeds a limit.

In modern instrumentation, the mechanical bar has been replaced with an array of electronically controlled lights of a single color, arranged in a series of illuminatable segments adjacent to markings corresponding to input values. Devices of this type and their distributors or manufacturers include: the Universal Bargraph, by the Triplett Corporation, One Triplett Drive, Bluffton, Ohio; Solid State Analog Panel Meters, by Bowmar-/ALI, 531 Main Street, Acton, Mass.; and Vibration Monitors, by PMC/BETA Corporation, 4 Tech Circle, Natick, Mass. Alternatively, the illuminated segments have been arranged in linearly displaced groups, each group having a fixed color to identify the different significance of the values in the different groups. This limits the points of change to fixed values. A device of this type is disclosed in U.S. Pat. No. 4,874,253 to Pompei et al. Some of the devices have supplemental alphanumeric displays which compliment the bargraphs by displaying additional information which the limited prior art devices are unable to accommodate.

A common flaw in all of the prior art bargraphs is their limited capability to clearly present warning or danger information in a single display. In prior art bargraph displays, the existence of an input which exceeds a value or represents a warning may only be represented by a single LED illumination which cannot be seen at a distance.

SUMMARY OF THE INVENTION

In surmounting the disadvantages of prior art bargraphs, the invention comprises a bargraph array of selectable color illuminatable segments. A control circuit illuminates a linear array of segments containing multi-color light-emitting diodes (LED's), corresponding to an input level concurrently with selection of an illumination color for simultaneous illumination of all of the segments corresponding to one or more conditions.

In a first embodiment, a series of segments are illuminated in a first color to reflect an input value. A color logic unit in a control circuit causes the entire series of illuminated segments, corresponding to the present data value, to change to a second color when the level reaches or exceeds a set point.

In a second embodiment, a series of segments are selectively illuminated in response of an output signal from a control circuit. The control circuit uses a scanning address counter in combination with a logic circuit to determine the illumination status of each of the individual segments as they are illuminated in a first color in response to input data. Comparators compare digitized data and set-point levels with the address of the scanning counter to determine the required illumination status of each segment as it is addressed. When a first set point is equalled or exceeded by the input, the color select logic unit causes all of the illuminated segments to turn a second color. If the data level equals or exceeds the second set-point level, the color select logic unit causes the illuminated segments to turn a third color.

All of the embodiments may incorporate logic circuits to selectively illuminate set points and the zero point a different color than the other illuminated segments. Segments containing LED's are arranged in either a linear or an arcuate arrangement and have light isolating material between each of the segments to prevent illumination of adjacent unintended segments. Each segment contains a separately activatable red and a green LED which, when jointly illuminated, produce yellow light. Additional features of the bargraph apparatus include latch and reset provisions, peak hold and sensor integrity circuitry, and a numeric display. An additional dimension of information can be provided by flashing the LED's.

BRIEF DESCRIPTION OF THE DRAWINGS

A more complete understanding of the present invention and the attendant advantages and features thereof will be more readily understood by reference to the following, solely exemplary, detailed description when considered in conjunction with the accompanying drawings wherein.

DETAILED DESCRIPTION OF THE INVENTION

Figure 1:
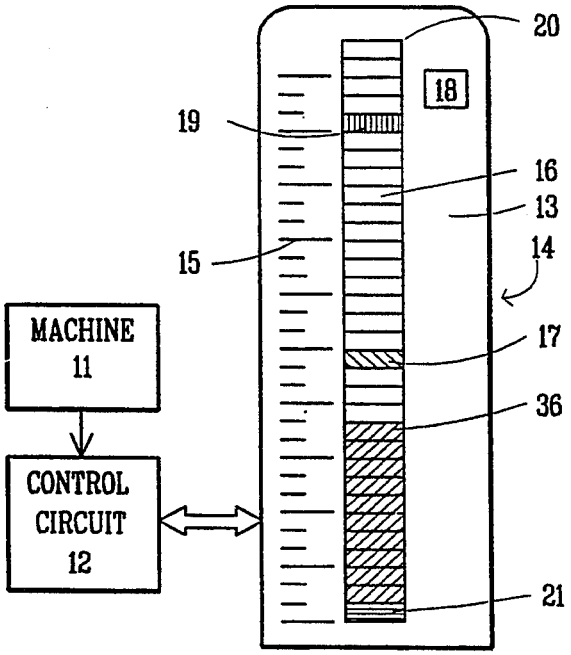
FIG. 1 is a front view of a multi-color bargraph apparatus which converts signal input from a single channel, dual channel or bi-polar control circuit into a visual readout.

FIG. 1 illustrates a multi-color bargraph monitor and display apparatus 10 which may be used to monitor the status of a machine or process 11. A control circuit 12 converts signal input from the machine or process 11 into an easy-to-interpret visual form via a visual display unit 14.

The visual display unit 14, shown in FIG. 1, includes a strip of commercially available light diffusing segments 16, each segment 16 containing two individual but intimately associated light-emitting packages under a single lens, but diodes having differing emission wavelengths such as red and green so as to create the effect of a multiple-color unit. The segments 16 are stacked one upon the other, or side-by-side, creating a linear array of segments which may be mounted vertically, horizontally, or at another angle in a housing 13. The housing 13 has marks 15 painted or inscribed thereon to indicate various data levels such as voltage current, pressure, rate, etc.

Figure 2:
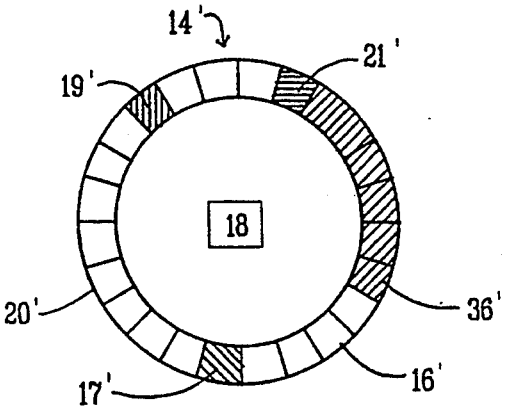
FIG. 2 is a front view of an arcuate display unit which is compatible with the invention of FIG. 1.
Figure 3:
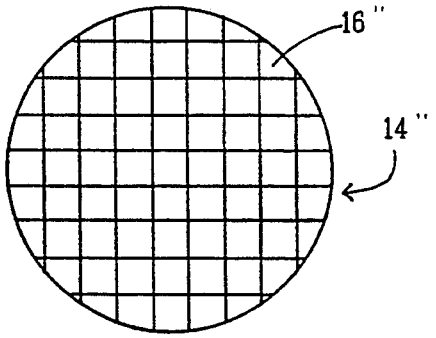
FIG. 3 is a front view of another disk-shaped display unit which is compatible with the invention of FIG. 1.

FIG. 2 illustrates a configuration of alternate visual display unit 14' whereby the segments 16' are arranged in a circular arc. FIG. 3 depicts another configuration of the visual display unit 14", wherein substantially the entire surface of a disk is covered with segments 16". All of the configurations of the visual display units 14, 14' and 14" may include a numeric character display unit 18 for operator convenience, or as a backup to the primary display.

An important feature in all of the embodiments of the bargraph apparatus of FIGS. 1, 2 and 3, is the controlled illumination of single or multiple LED segments 16 in varying colors as a function of the parameters established by operator-adjustable set points for caution or danger warnings. For example, a single segment or LED 16, 16', 16" of the visual display units 14, 14', 14" may be illuminated yellow when the segments 16, 16', 16" corresponding to pre-set "alarm" or cautionary set point segments 17, 17' is addressed during the scan, and segments 16, 16', 16" corresponding to "trip" or danger set point segments 19, 19' may be illuminated red. In addition to illuminating segments 16, 16', 16" corresponding to various set points, the input data values 36, 36' are shown on the visual display units 14, 14' as a solid, continuous bar or ring of illuminated segments 16 extending from a segment 16, 16' identified as a "zero" or least level representation segments 21, 21' to segments corresponding to the actual data values 36, 36'. The entire bar of segments 16, 16' may be shown in green, indicating normal or safe operation, but when the data value exceeds the alarm or cautionary set point, the entire bar or ring of illuminated segments illuminates yellow by operation of control circuitry 12. If the trip or danger set point is equalled or exceeded, the entire bar or ring of illuminated segments turns red.

The ability of the visual display unit to entirely change color as a function of the relation of an input level to a set point adjustment has several important advantages over prior art indicators. It is thus possible for an operator to monitor from afar many displays for not only the data value, but also its relationship to the set points; i.e., well below the alarm value, close to the alarm value, or in excess of the alarm value. An operator, by virtue of the entire illuminated portion of a visual display unit being illuminated in green, yellow, or red, can instantly, and at a distance, be alerted to the need for immediate attention to a specific parameter if required.

Figure 4:
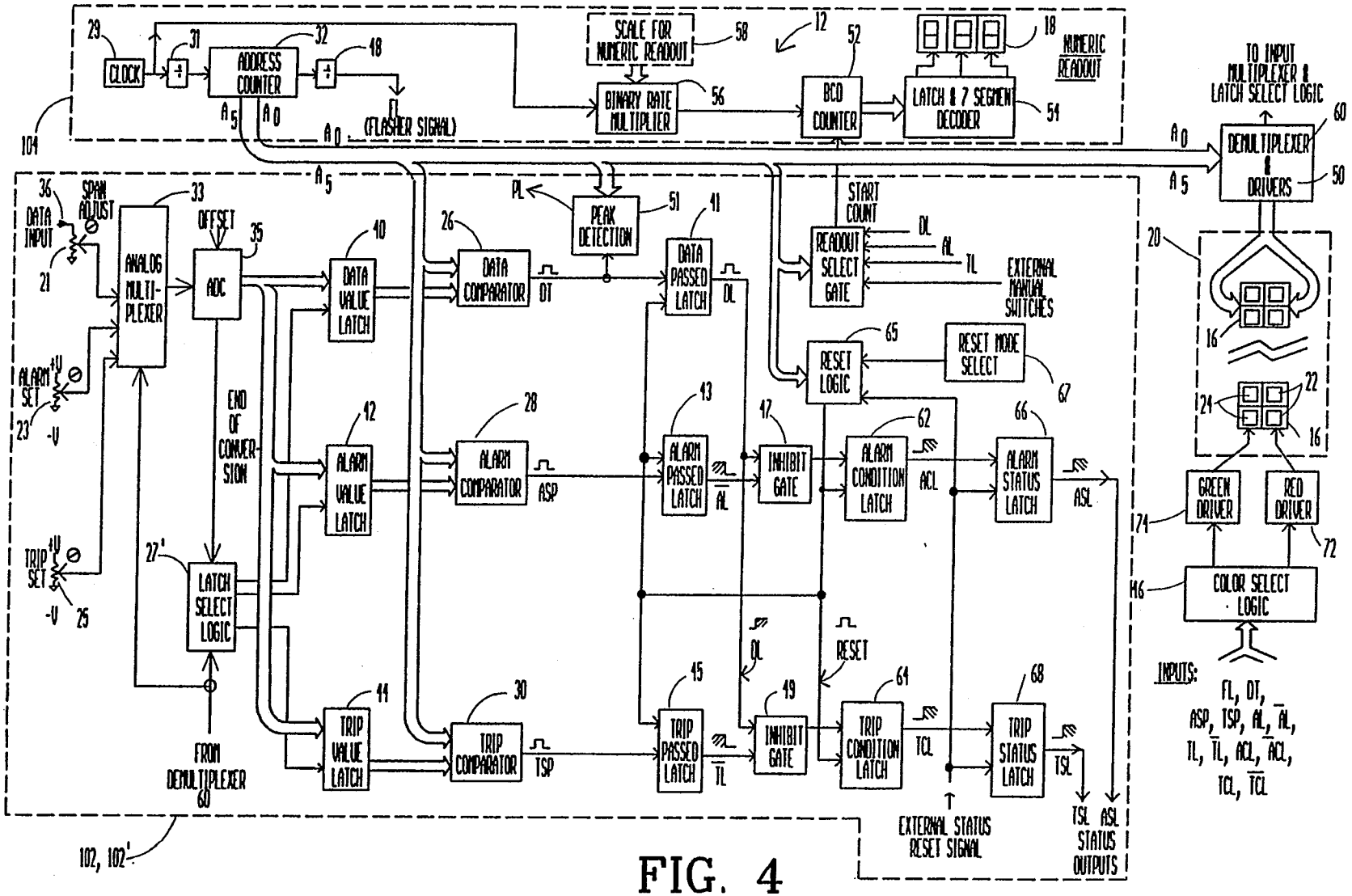
FIG. 4 is a block diagram for a uni-polar, three-color control circuit for the invention of FIG. 1.

Referring to FIG. 4, a block diagram of a uni-polar three-color control circuit 12, useful for single or dual channel applications, is shown. In the descriptions of the various control circuits 12 which follow, a linear format, hereinafter referred to as a bargraph 20, is the primary component of the visual display unit 14, however, the same circuitry may be used for other display formats as well. The bargraph 20 may consist of any number of segments of LED's desired.

One embodiment of the apparatus 10 uses a scale having 50 increments, requiring 51 illuminated segments 16, which represents a good compromise between complexity and size of the embodiment of the control circuit 12 and resolution of the bargraph 20. Process industry specifications such as API-670 require a resolution of 2 percent, which is satisfied by this number of segments 16. In one embodiment of the apparatus 10, rectangular, multi-color capable segments 16 are stacked to obtain a 51-segment bargraph 20, which is 0.20 inches wide and 4.59 inches long.

To achieve acceptable contrast, the segments 16 are optically isolated from each other in order to prevent light from an illuminated segment 16 from passing into the non-illuminated segments 16 adjacent to it. Optical isolation between elements is accomplished utilizing total internal reflection, as in a fiber-optic fiber, or an opaque, reflective material coating such as metallic foil or vacuum metalizing.

Light-emitting diodes are used in the segments 16 because they provide a bright display which ensures good visibility at a distance. In a present embodiment, each of the multi-color segments 16 contains two separate LED semiconductor emitters, one red emitter 22 and another green emitter 24, which are both housed in close or intimate proximity within a single molded element which has a diffuser lens imparting the effect of a single, multi-color emitter. The red and green LED's 22 and 24 share a common cathode, with separate anodes for red and green. Yellow light may be obtained by illuminating both red emitter 22 and green emitter 24 simultaneously or alternately; the hue depends upon the relative average currents of the red emitter 22 and green emitter 24. Each segment 16 may also be caused to flash, blink, or illuminate steadily. Furthermore, while the embodiments herein described only use three specific colors, others may be substituted, and more than three colors may be incorporated into the bargraph 20. It is also contemplated that true multi-color LED's be substituted for the bi-color LED's presently housed in each segment 16.

Data and set-point levels or values may be supplied to the apparatus in either analog or digital form. However, cost reduction is achieved by using analog information for scaling of the data, and storage of the set-points in non-volatile form.

In general, the operation of the control circuit 12 of FIG. 4 is as follows. The control circuit 12 causes the segments 16 of the bargraph 20 to be scanned from the top down, or from the bottom upward, continuously comparing the input data value 36 with the segment 16 being addressed. From this, it is possible to turn the segments 16 on or off, depending upon the display desired, thereby producing a continuous solid bar from zero up to the actual data value. If no set points are used, it does not really matter which direction of scan is chosen. In a bottom-up scan, the segments 16 can be turned on initially and turned off when the desired level is reached; in the top-down scan, the reverse can be true; either will produce a solid bar of colored light extending upward from zero.

In this embodiment, a choice of scan direction is required when set points are included in the control circuit 12, because when the data input value 36 exceeds a pre-set value, the bargraph 20 needs to change color or flash. Thus, scan direction is important because the control circuit 12 must be able to determine whether a segment 16, representing the present data value 36, is above or below a segment 16 corresponding to a set point. For any display having a bar extending upward from zero, and in which the color or flash rate of the bargraph 20 needs to correspond to the relation of the data value 36 to the set point within a single scan, a "top-down" scan is used because the appropriate color of illumination for each segment 16 should be set before the segment is illuminated. Also, the set points may function as either "low" limits or "high" limits and the circuitry provided accordingly.

The following more detailed description of the scanning process aids understanding of the operation of the apparatus 10. Under normal operation, a scanning counter 32 driven by a clock 29 through a divider 31 feeds a demultiplexer 60 which sequentially energizes each element 22 and 24 of the segment 16 of the bargraph 20. As described below, data and set point levels are applied to respective comparators 26, 28 and 30 along with the output of counter 32. These components determine if the address of an enabled segment 16 matches one of the data or set point values. If so, the comparator corresponding to that parameter produces an output pulse during the time that the segment 16 is enabled. The output pulses from comparators 26, 28 and 30 are used to set respective latches 41, 43 and 45, which, by inhibiting the pulse from a second comparator, can record a particular relationship between two values. The relative amplitudes of the data and set points are thereby converted to time differences. The chronology of the comparator outputs determines if the value of one parameter is greater than that of another, and also the relationship of the values of all of the parameters to the "full-scale" or top value of the bargraph display. Depending upon the positions of the set points, the chronology of the comparator outputs determines which action to take.

For example, if the trip comparator 30 outputs a pulse before the data comparator 26, then the data value 36 is below the trip set point 19, and no trip indication is displayed. If the data comparator 26 outputs a pulse before the alarm comparator 28, then the data value 36 exceeds the alarm set point 17, and an alarm condition is displayed. Finally, if the alarm comparator 28 outputs a pulse before the data comparator 26, then the data value 36 is below the alarm set point, signifying normal operation and so indicated by a green bargraph 20. The apparatus 10 may send signals corresponding to the current status of the input device to other remote devices, and in many cases, the apparatus 10 can serve as a complete controller for a process or machine 11. The set points may act as "high" or "low" limits by configuring the inhibition of the latches for the alarm or trip conditions.

Referring to FIG. 4, the control circuit 12 includes a six-bit counter 32, fed by an oscillator 29 and countdown circuit 31 to generate clock signals for synchronizing the operation of all elements 22 and 24 of segments 16 of the bargraph. The counter 32 generates a six-bit binary clock counter address which controls the scanning of the 51 LED's 16 and the operation of an input multiplexer 33 via a demultiplexer 60 described below, as well as generating a 2 Hz signal from a divider 48 for controlling the flashing of the LED segments 16 under predetermined circumstances as selected by the operator.

Normally, 51 LED segments 16 are scanned sequentially, starting from the top of the bargraph 20, enabling them successively downward toward the last LED segment 16 which represents zero 21. The basic LED scan rate in one embodiment is approximately 3300 Hz, thus each LED 22 and 24 is potentially enabled for about 300 microseconds. The six-bit counter 32 has a total of 64 counts or addresses. Since 64×300 microseconds=19,200 microseconds, the entire exemplary bargraph 20 is scanned every 19.2 milliseconds, or approximately 52 times per second. This rate is fast enough to prevent discernable flickering of the bargraph 20.

The input multiplexer 33 selects up to four inputs at a rate of 52 Hz. In one configuration, these are input data level 36 adjusted by potentiometer 21, an alarm set point set by potentiometer 23 and trip set point set by a potentiometer 25. Thus, each of the inputs are sampled every 77 milliseconds, corresponding to a sample rate of 13 Hz. This is sufficient for most process data.

An Analog-to-digital converter (ADC) 35 sequentially digitizes each of the three input signals as they are presented in turn to its input from multiplexer 33. At the end of each conversion, one of the respective latches 40, 42 and 44, corresponding to each ADC input, is enabled by latch select logic 27 driven from demultiplexer 60, and the digitized value is stored in that latch. A typical high speed ADC is capable of making required conversions in 120 microseconds.

To energize the LED segments 16 corresponding to the input data level, and all of those below it, a data comparator 26 compares the scan address value from counter 32 with the data value from latch 40. The data comparator 26 will give a 300 $\mu$ sec. output (DT) when the two values are equal. (Comparators 28 and 30 and latches 42 and 44 act similarly and provide ASP and TSP outputs.) The DT pulse is used to set a data passed latch 41 indicating that the segment corresponding to the data level has been reached in the downward scan. Its output is also fed to a color select logic 46 which energizes the proper LED elements 22 and/or 24 at all segments from that point on in the scan. When the data level is below both the alarm and trip set-points, the green LED's 24 are illuminated, turning the segments 16 green and thereby producing a green bargraph 20 extending from the data value 36 down to zero 21. (The ASP and TSP outputs are used to set latches 43 and 45 for the current scan to identify elements 22 and 24 to illuminate.) At the end of each scan, all latches 41, 43, 45 are reset by a signal derived from the output of demultiplexer 60.

The alarm and trip point (or two condition indicating) circuitry has two functions, first to drive the color of all illuminated segments 16, and second to continuously mark the level of each set point. These functions are achieved by first latching the alarm and trip values (examples of first and second conditions to be displayed as solid color bars) in latches 42 and 44 respectively as noted above. The points in the repeating sequence of digital numbers from counter 32 correspond to the alarm and trip points, and the comparators 28 and 30 are activated to provide respectively an ASP and a TSP output pulse. These pulses in turn set respective latches 43 and 45 which provide output pulses AL and TL respectively. During each scan, the latch 41 produces the output pulse DL coincident with the counter 32 reaching the digital value corresponding to the digitized input level.

Figure 5:
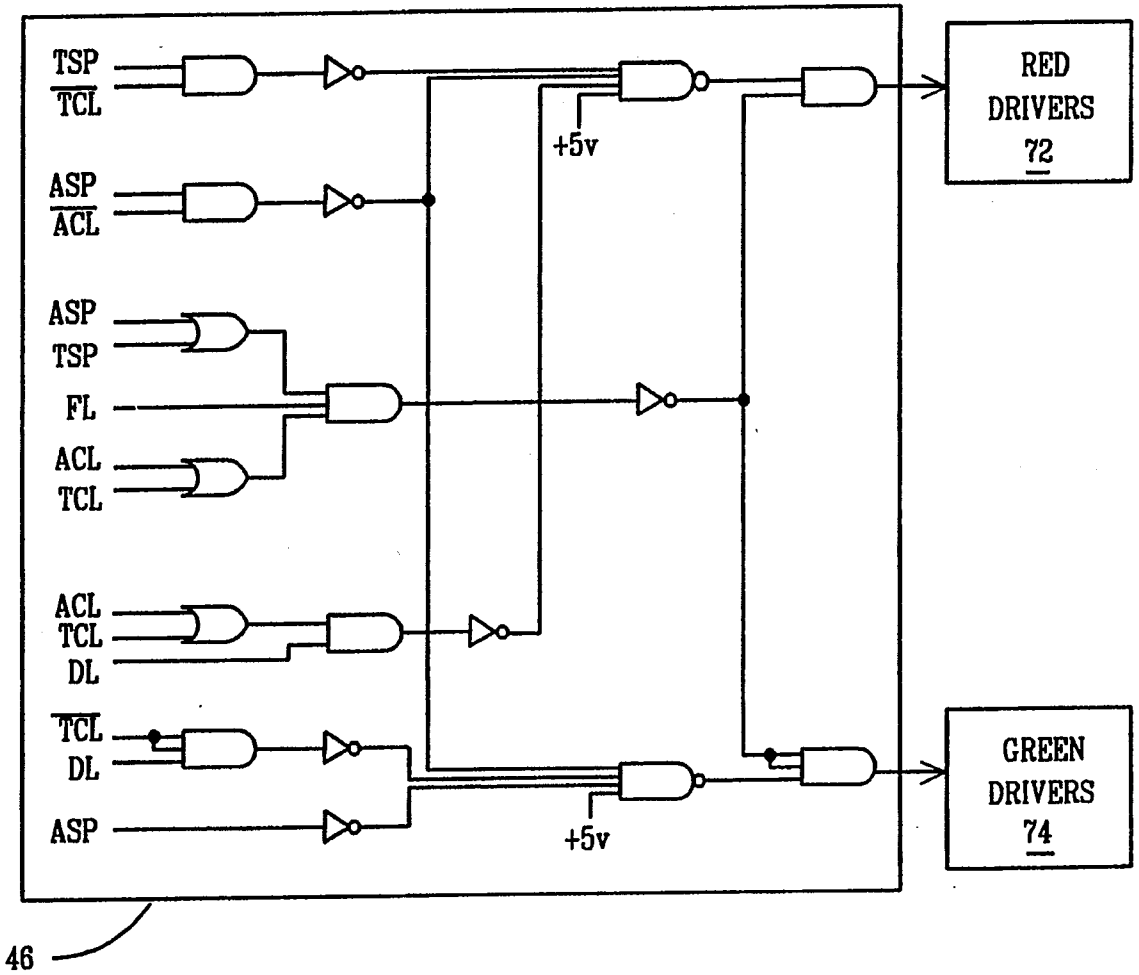
FIG. 5 is a schematic of a color select logic circuit for the invention of FIG. 1.

Inhibit gates 47 and 49 each receive the DL pulse and respectively receive the AL and TL pulses. The inhibit gates operate to pass the AL and TL signals only if they occur after the DL signal deactivates the inhibit function, thereby indicating that the input level is above the corresponding set point. The alarm and trip condition latches 62 and 64 are fed the AL and TL signals and are set, accordingly and respectively, when the input level occurs above the alarm and trip set point levels. The outputs of these latches, ACL and TCL respectively are provided to the color logic 46 which employs the logic green=not ACL and not TCL, or ACL and not TCL, Red=ACL or TCL to activate the green and red drivers 74 and 72 to determine which color LED is illuminated in each segment 16 from the input data level on down the line of segments. FIG. 5 depicts one embodiment of a circuit schematic for the color logic 46. A reset logic circuit 65 provides a reset to latches 41, 43, 45, 62 and 64 automatically each cycle at a preset point in the count of counter 32 or by external switch activation. Latches 40, 42, and 44 are enabled each scan.

The lighting of the set point segment at the corresponding color for the level it represents is accomplished by the logic 46 from the ASP and TSP signals using the logic Green=ASP and not TSP, Red=ASP or TSP. Latches 66 and 68 hold indefinitely an indication that an alarm and trip level has respectively been exceeded until manually reset and their ASL and TSL outputs may be used elsewhere in process control.

In many process applications, it is desirable to maintain an alarm indication after it has been triggered, even though the data value 36 may have subsequently fallen below the alarm set point, until the operator has noted and acknowledged the alarm. This is especially important if the alarm or trip condition is not configured to shut down the machine or process 11 automatically.

The reset circuitry may include for reset logic unit 65, a reset mode select unit 67 that provides for various reset options. In a first option, the alarm condition latch 62 and the trip condition latch 64 are automatically reset at the end of a scan as noted above. If the data value 36 goes below the set points, the bargraph 20 returns to a yellow or green color, and only the alarm status latch 66 and the trip status latch 68 retain the previous status until manually reset. In a second option selected from unit 66, the cyclical reset is inhibited and, after an alarm or trip condition, the bargraph 20 remains yellow or red until activation of the manual reset.

Another useful feature is in indicator of sensor integrity. Many applications require an "OK" lamp to indicate that a data-providing sensor is operating properly, so that an alarm condition due to sensor failure may be properly identified. Sensor failure is identified in one embodiment of the multi-color bargraph apparatus 10 by the logic circuit 46 in response to the FL output of divider 48 so that the lowermost (#1) segment 16, in a uni-polar display, or the central (#26) segment 16, in a bi-polar display is always caused in each cycle, to flash. To enhance the visibility of the flashing segment 16, it may always be a predetermined color, such as green, regardless of the color of the other segments 16.

A peak level detector 51 may also be incorporated to record the value of the highest data value 36 reached. This level may be recorded in a latch, and displayed or fed to an external output.

Figure 6:
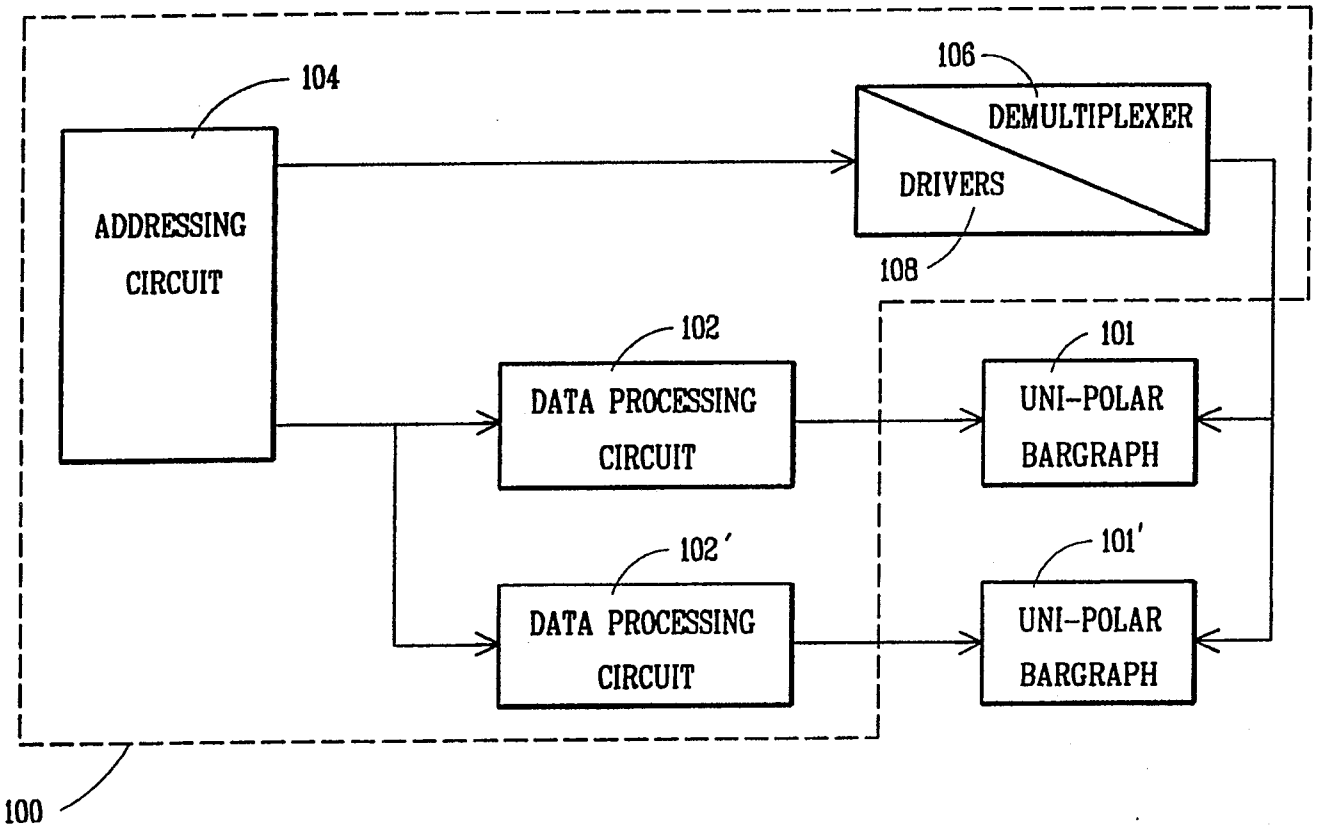
FIG. 6 is a block diagram for a two-channel, uni-polar, three-color control circuit for the invention of FIG. 1.

Referring to FIG. 6, a dual channel control circuit 100 for two separate uni-polar bargraphs 101 and 101' is shown. The dual channel control circuit 100 has two substantially identical data processing circuits 102 and 102', each of which is responsive to a common addressing circuit 104, as identified in FIG. 4. The bargraphs 101 and 101' are responsive to data processing circuits 102 and 102' respectively, and to the demultiplexer 106 and drivers 108. Operation of the dual channel control circuit 100 is otherwise as previously described for the single-channel control circuit 12 of FIG. 4.

Figure 7:
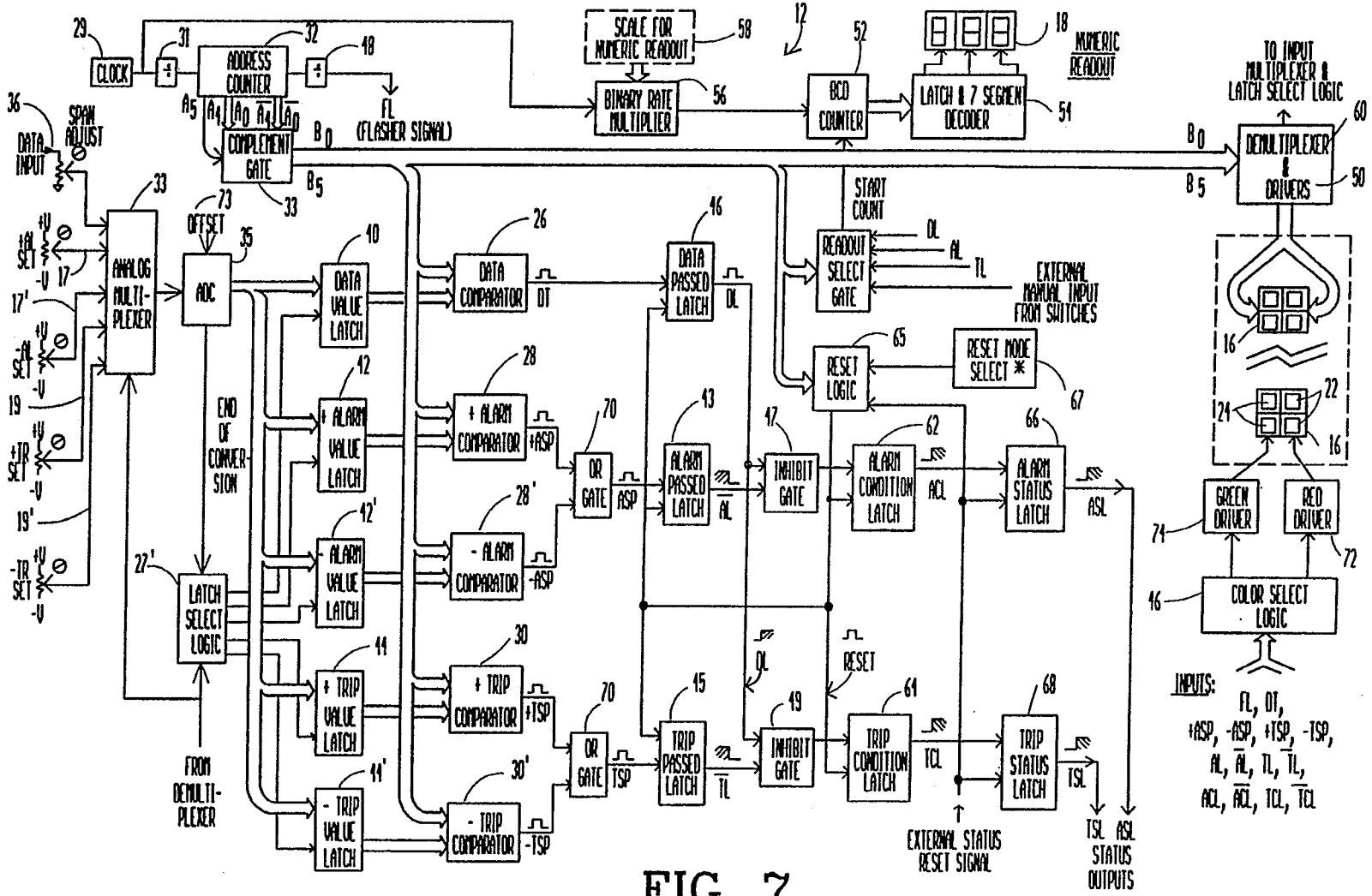
FIG. 7 is a block diagram for a bi-polar, three-color control circuit for the invention of FIG. 1.

Referring to FIG. 7, a bi-polar control circuit is shown which controls a bargraph 20 having an intermediate "zero" such as at its center and which visually presents both positive and negative data values. For a 51-segment display center zero this would be LED segment #26, with positive values being upward toward segment #51, and negative values downward toward segment #1. The bi-polar control circuit of FIG. 7 accommodates both positive and negative values for alarm set points, and positive and negative values for trip set-points of different magnitudes. For a center-zero display, this means that the scan must be from in two parts, the first scan maximum positive (or #51) toward zero (or #26), and the second scan from maximum negative (or #1) toward zero (or #26). Thus the scan needs to be as follows: 51, 50, 49, 48, . . . 28, 27, 26; 1, 2, 3, 4, . . . 23, 24, 25.

In the bi-polar control circuit, the analog-to-digital converter 35 accepts both negative and positive inputs from a five input multiplexer 33' having the added negative set point inputs 17' and 19' by introducing an offset 73. In this configuration, the six-bit binary output value will range from binary (000000) for maximum negative input, to (100000) for zero input, to (111111+one LSB) for maximum positive input. The scan address must be consistent with these binary numbers in order to obtain an accurate comparison of the scan address with the output of the analog to digital converter. This is accomplished by modifying the address output of the address counter 32 in a complement gate 33 for use as the scan address. This scan address may then be used as an input to the input digital data and set-point comparators 26, 30, 30', 28, and 28', and to drive the demultiplexer 60 for selecting (scanning) the LED segments 16. The comparators 28' and 30', fed by negative set point latches 42' and 44', function as described above for negative values.

When the bargraph apparatus 10 is configured with a bi-polar control circuit 12, the latches 41, 43, and 45 which are set by the output from the comparators 26, 30, 30', 28, and 28', must be reset when the scan reaches the center of the bargraph 20, whether from the top down or the bottom up. Thus, it is necessary for the latches 41, 43, and 45 to be reset twice in every complete scan, rather than a single time as required control circuit 12 for the uni-polar display of FIG. 4. The +ASP, −SP, +TSP and −TSP outputs of comparators 28, 28' and 30, 30' are respectively OR'd in gates 70, 70' before application to latches 43 and 45. This operates on the assumption that the magnitude exceedance of each set point generates the same bargraph color independent of the polarity of the signal exceeded.

A bargraph 20 has the advantage of providing a readily assimilable indication of the input parameters, and a scale or marks 15, as shown in FIG. 1, permits the numeric equivalents of the values to be read. But, a bargraph 20 with 51 segments 16 can only create a resolution of 2 percent. Therefore, a numeric or an alpha-numeric digital display 18 may be incorporated in the apparatus 10, by means of appropriate switches to present the level of the input at high resolution, peak data level, and set-point values, etc.

To create a typical 7-segment type character, the control circuit 12 must provide for scaling of the numeric readout to the bargraph 20 and for the discrete nature of the character. Since any given segment 16 of the bargraph 20 will represent a particular range of data input values within the resolution of the numeric display, it is essential for the numeric display 18 to match this range closely. This situation is complicated by the fact that the full-scale range of the bargraph 20 may not be evenly divisible by 50 increments. For example, with a full-scale range of 30 units of a parameter, each increment will represent 30/50, or 0.60 units, not a whole number. Ideally, the numeric display 18 represents the mid-point of the data value range represented by the illumination of a single segment 16.

A numeric readout may be generated in the apparatus 10 as shown in FIGS. 4, 6 and 7, by multiplexing the signal from the clock 29 by a rate multiplier 56 which is in turn gated into a decimal counter 52 when a corresponding comparator latch gives an output (for example, DL). If the clock signal operates the decimal counter 52 during the time the DL signal is a "one," then the decimal number in the decimal counter 52 will be proportional to the time the passage latch signal DL is present, this being the time it takes the scan counter to count from the input data level down to zero. The number in the decimal counter 52 will thus be proportional to the input data level and the clock frequency which feeds it. This number is then saved in a latch 54 and drives, through decoders, a conventional 7-segment character. In a bi-polar control circuit, the polarity ("sign") may be derived from the value of the MSB of the scan address.

Deriving the input frequency of the decimal counter 52 from the same master clock 29 used for the rest of the control circuit 12 assures that the scaling of the numeric display 18 and the bargraph 20 are properly related. By varying a countdown placed between the master clock 29 and the decimal counter 52, the scaling of the numeric display relative to the bargraph may be adjusted. In the control circuits shown in FIGS. 4 and 7, this is accomplished with binary rate multiplier 56, whose binary multiplication is set by an input from a DIP-Switch 58 or a plug-in jumper array, and may be adjusted for the scaling required. The binary rate multiplier 56 may also provide part of the countdown needed for the clock 32.

Switching the input to the numeric counter gate permits not only the data, but also the settings for the set-points, to be read on the numeric display. For a dual-channel control circuit of FIG. 4, the gating is modified to fit requirements. For example, a single numeric display is sufficient to read all of the set-point adjustments. By feeding the data latch signals DL-1 and DL-2 to an "OR" gate, the decimal display counter 52 may be enabled by whichever of the two signals occurs first, thereby automatically reading the higher of the two data values 36.

Figure 8:
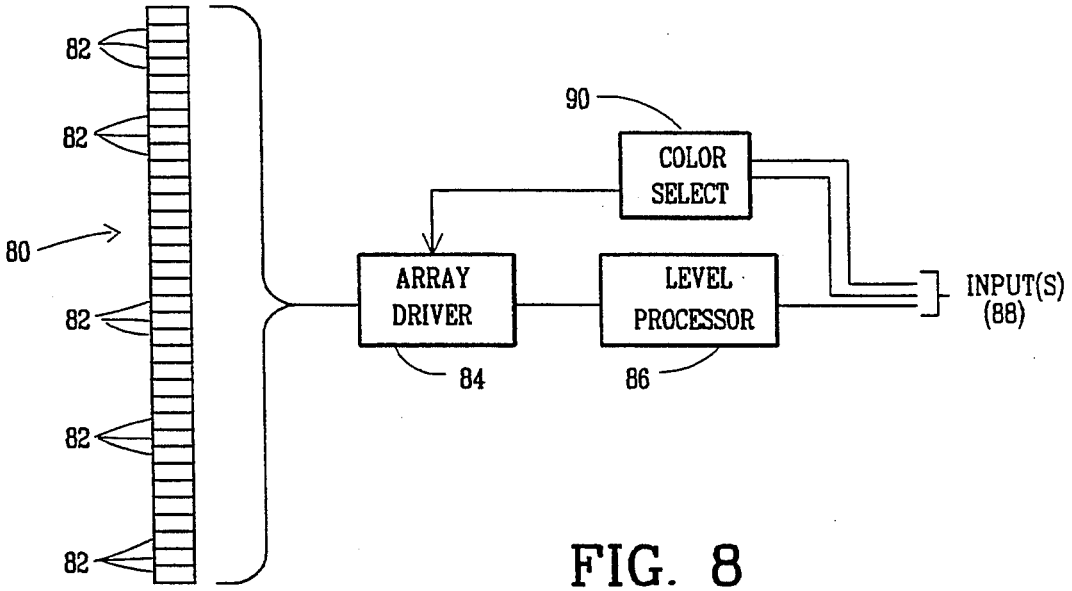
FIG. 8 is a generalized block diagram of circuitry utilizing the invention.

The general nature of the invention is illustrated by FIG. 8. As shown in FIG. 8, a linear array 80 of multi-color LED segments 82 is driven by an array driver 84 which decodes an input level representation, such as a digital signal, from a level processor 86 such as an analog to digital, digital-to-digital or other circuit that receive an input 88. The array driver selects the one or more LED segments 82 to be illuminated and applies an illuminating current to each such LED segment 82. A color select circuit 90, responds to the same or other parameters from input 88 to control a feature of the applied segment drive from drive 84 to each of plural segment leads. The color select circuit 90 determines the color of all the illuminated segments, and may also include level selector condition responsive logic to identify which color all the segments are to show. While a scanning technique is shown, it should be noted that other digital systems or microprocessor based units could be used.

A variety of modifications and variation of the present invention are possible in light of the above teachings. It is therefore to be understood that, within the scope of the appended claims, the present invention may be practiced otherwise than as specifically described hereinabove.

We claim:

1. A multi-color bargraph comprising:

a plurality of set point selectors including at least one alarm set point selector at an operator selectable level for setting an alarm level and at least one trip set point selector at an operator selectable level for setting a trip level;

at least one analog-to-digital converter for converting an input signal level, said alarm level, and said trip level to a digital input level, a digital alarm level, and a digital trip level respectively;

a plurality of latches comprising a data latch for latching said digital input level, an alarm latch for latching when said digital input level exceeds said digital alarm level and a trip latch for latching when said digital input level exceeds said digital trip level;

a display comprising a plurality of multi-color segments, each of said plurality of multi-color segments comprising a first color emitting diode and a second color emitting diode covered by a single lens, said first and said second color emitting diode illuminating individually and in combination to produce a first color, a second color and a third color;

said plurality of multi-colored segments including an alarm segment corresponding to said alarm level, an alarm segment illuminator for illuminating said alarm segment in a color different from other illuminated segments, a trip segment corresponding to said trip level, and a trip segment illuminator for illuminating said trip segment in a color different from other illuminated segments;

an address counter providing a unique recognition of each of said plurality of multi-color segments by assigning a plurality of address values thereto, the values extending from a minimum to a maximum correlated to the position of each multi-color segment;

a comparator circuit including a data comparator for comparing each of said address values with a value in said data latch, an alarm comparator for comparing each of said address values with said alarm latch, and a trip comparator for comparing each of said address values with a value in said trip latch to provide a latched and a non-latched state for each of said plurality of latches according to the corresponding comparator output; and at least one color select logic circuit providing a color select signal in response to said latched and said non-latched state for each said latch for illuminating a discrete number of said plurality of multi-color segments corresponding to said data value in a single color associated with a logical function of said comparator outputs.

2. The bargraph of claim 1, wherein said plurality of multi-colored segments comprises at least one less than the least significant level segment and an illuminator for illuminating that segment irrespective of said input signal level.

3. The bargraph of claim 1, wherein said plurality of multi-color segments is arranged in a linear configuration.

4. The bargraph of claim 1, wherein said plurality of multi-color segments is arranged in a circular arc.

5. The bargraph of claim 1, wherein said plurality of multi-color segments are configured in a two-dimensional array.

6. The bargraph of claim 1, further comprising an optical isolator preventing light from an illuminated segment from illuminating a non-illuminated segment.

7. The bargraph of claim 1, further comprising an operator resettable latch circuit for storing a representation of a set point exceedance.

8. The bargraph of claim 1, further comprising an operator resettable latch circuit for illuminating said discrete number of said plurality of multi-color segments in color different from other illuminated segments, when a previous value of said input signal level has equalled or exceeded a level established by said plurality of set point selectors.

9. The bargraph of claim 1, further comprising a peak hold circuit for illuminating at least one of said plurality of multi-color segments corresponding to a maximum input signal level.

10. The bargraph of claim 1, further comprising a sensor integrity circuit for monitoring a failure status of a device and indicating that status by color of illumination of at least one of said plurality of multi-color segments.

11. The bargraph of claim 1, further comprising a numeric display for displaying said input signal level.

* * * * *

UNITED STATES PATENT AND TRADEMARK OFFICE

CERTIFICATE OF CORRECTION

PATENT NO. : 5,369,416

DATED : Nov. 29, 1994

INVENTOR(S) : Donald Haverty, et al.

It is certified that error appears in the above-indentified patent and that said Letters Patent is hereby corrected as shown below:

Column 8, line 43, "+ASP, -SP," should read --+ASP, -ASP,--.

Signed and Sealed this

Fifth Day of September, 1995

Bruce Lehman

*Attest:*

BRUCE LEHMAN

*Attesting Officer*

*Commissioner of Patents and Trademarks*